United States Patent [19]

Dusar

[11] Patent Number: 4,672,694

[45] Date of Patent: Jun. 16, 1987

[54] MOVEABLE LOWER GUIDE FOR SLIDING DOORS

[76] Inventor: Heinz Dusar, Unterer Kümmelsbergweg 19, 5450 Neuwied 14, Fed. Rep. of Germany

[21] Appl. No.: 893,664

[22] Filed: Aug. 6, 1986

[51] Int. Cl.[4] ..... A47H 15/00

[52] U.S. Cl. ..... 4/607; 16/96 R; 49/411

[58] Field of Search ..... 4/607-609; 49/404, 411, 412; 16/87, 90, 96 R

[56] References Cited

U.S. PATENT DOCUMENTS 3,701,179 10/1972 Cox ..... 16/90
4,228,560 10/1980 Baus ..... 4/607
4,486,980 12/1984 O'Bar ..... 49/411

FOREIGN PATENT DOCUMENTS 2845876 4/1980 Fed. Rep. of Germany ..... 4/607

*Primary Examiner*—Stephen Marcus
*Assistant Examiner*—L. J. Peters
*Attorney, Agent, or Firm*—Becker & Becker

[57] ABSTRACT

A shower partition with one or a plurality of door elements (1), that are supported on an upper rail and which engage with extension pieces (2) or an angled section (3) at the lower end in a recess (4) of a base rail (5) of which the wall section that is proximate to the shower-stall interior is supported, in such a manner as to be moveable on the remaining section of the base rail (5) and is configured, for example, as a rod (9) such that the wall section (rod 9) can be moved from a position that overlaps the angled section (3) or the extension piece (2) of the door element or elements (1) into a position that permits a specific displacement of the door elements (1) transversely to their plane in the direction of the shower-stall interior.

7 Claims, 4 Drawing Figures

MOVEABLE LOWER GUIDE FOR SLIDING DOORS

BACKGROUND OF THE INVENTION

The present invention relates to a shower stall or partition having one or more door elements, with one end of each door element being supported or suspended in an upper, horizontal frame portion of a fixed frame in such a way as to be movably guided via rollers, slides, or the like, while the other, lower end of each door element is provide with an extension having an upwardly angled piece that extends into a downwardly open recess of a bottom rail that forms a further horizontal frame portion of the fixed frame. Shower stalls of this general type are known.

To be able to clean the door element or elements of a shower stall of the aforementioned type, it is desirable to be able to periodically release or remove the door element or elements from their guides in the region of the bottom rail, especially to be able to pivot them, at least to a certain extent, in the direction toward the interior of the shower stall, without the necessity for having to raise or disconnect the guide or suspension elements in the upper frame portion. To solve this problem, it would be possible to configure the extensions that are located at the lower ends of the door elements and are provided with the upwardly angled pieces in such a way that they are sufficiently elastic, for example by making them of a suitably thin, sheet-like piece of plastic, so that the extensions can be removed from the guides in the bottom rail by being bent. However, such a construction is unsatisfactory for many reasons. On the one hand, after having been used for a certain length of time, it is likely that cracks or similar damage will occur in the extensions. On the other hand, flexible extensions of this type are not suitable structural elements for providing a well-defined door element guide that is durable over a long period of time.

It is therefore an object of the present invention to provide a satisfactory structural solution that makes it possible, especially for cleaning purposes, to be able to periodically pivot the door element or elements of a shower stall to a certain extent in the direction toward the interior of the shower stall.

SUMMARY OF THE INVENTION

Pursuant to the present invention, this object is realized in an economical, simple, and elegant manner by supporting that wall portion of the recess (which serves for guiding the base of the door elements) that faces the door elements and the interior of the shower stall on the remainder of the bottom rail in such a way that this wall portion is movable relative thereto and can be shifted from a first position, in which the wall portion overlaps the angled pieces of the extensions of the door elements, into a second position which permits a certain amount of pivoting of the door elements, transverse to their plane, in the direction toward the interior of the shower stall.

A preferred and particularly simple embodiment that also satisfies all the requirements for hygiene is characterized in that a channel, groove, or the like is provided in the bottom rail on that side which faces the interior of the shower stall; this channel, groove, or the like extends in the longitudinal direction of the bottom rail, and has a cross-section in the shape of a part of a circle. A rod that conforms to the diameter of the channel, groove, or the like, and that has a cross-section in the shape of a part of a circle or circular ring, is supported or guided in the channel, groove, or the like in such a way that in can be rotated or pivoted about the common geometrical axis of the rod and the recess. In order to hold this rod in the recess, clip-like or bracket-like securing elements can be provided at suitable locations along the length of the bottom rail in the event that the extensions that are disposed on the door elements and are provided with the angled pieces have only a very short longitudinal dimension, so that the aforementioned securing elements, for example in the form of a clip, do not disrupt the possible back and forth movement of the door elements. Another possibility for retaining the rod in the recess is the provision of suitable supports or bearings for the two ends of the rod. These bearings are then provided in the base portions of the frame that are connected to the aforementioned bottom rail.

A further possible embodiment is characterized in that a channel, groove, or the like that extends in the longitudinal direction of the bottom rail is provided in the latter on that side which faces the interior of the shower stall; on that side which faces the interior of the shower stall, this channel, groove, or the like is provided with a strip-like element that is disposed on the bottom rail in such a way that it can be shifted in an approximately vertical plane. In a manner similar to that of the previous embodiment, the guide means for this strip-like element can be provided either only on the bottom rail via suitable guide elements, and/or can be provided in the region of the ends of this strip-like element on the two opposite base portions of the shower stall frame adjacent to the pertaining bottom rail.

A further possible embodiment for realizing the aforementioned object is characterized in that that portion of the bottom rail that forms the recess is connected to the remainder of the bottom rail in such a way that it is rotatable or pivotable about a horizontal axis that is remote from the interior of the shower stall.

Finally, an embodiment is possible in which the upper portion of the bottom rail, which forms the recess, is detachably connected to the remainder of the bottom rail. The structural embodiment can be such that the upper portion of the bottom rail can, via an extension having an approximately U-shaped cross-section, be placed on an approximately I-shaped extension of the remainder of the bottom rail.

Similar to the solution where the portion of the bottom rail that forms the recess is detachably connected to the remainder of the bottom rail, it is also possible in the case of the solution where that portion of the bottom rail that forms the recess is connected to the remainder of the bottom rail in such a way that it is pivotable about a horizontal axis that is remote from the interior of the shower stall, the rotational connection between the upper and lower portions of the bottom rail can be detachable. For this purpose, with appropriate structural dimensions, it is possible to take advantage of the elasticity of the material; consequently, plastics are particularly suitable for this structural embodiment.

BRIEF DESCRIPTION OF THE DRAWING

Four individual embodiments of the present invention are described in detail below with the aid of FIGS. 1 to 4.

Shown are

DESCRIPTION OF PREFERRED EMBODIMENTS

Figure 1:
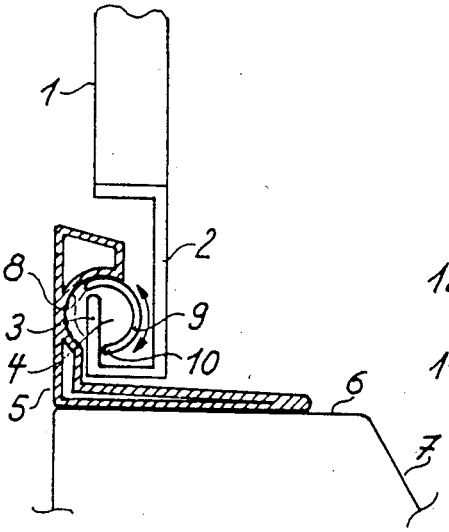
FIG. 1 the bottom rail of a familiar-type shower stall, here not further illustrated, and the directly adjacent portion of a movable door element, as a cross-sectional view with an inventively provided rod that is supported in the bottom rail in such a way as to be pivotable or rotatable, and which has a cross-sectional shape in the form of a portion of a circular ring, FIG. 2 a further possible embodiment of the inventive shower stall with a movable strip that is supported on the bottom rail and is used to vary the depth or size of the recess in which the angled piece of the extension of the door element moves, FIG. 3 a further inventive shower stall in which that area of the upper portion of the bottom rail that contains the recess for the angled piece of the extension of the door element is embodied in such a way that it is removable from the remainder of the bottom rail, and FIG. 4 a further possible embodiment of the inventive shower stall, in which the upper portion of the bottom rail is pivotably supported on the remainder of the bottom rail and could, if desired, be removable therefrom.

FIG. 1 shows a door element 1 of a familiar shower stall or compartment, which is here not further illustrated. The upper end of the door element is guided in a known manner via rollers, slides, or similar structural elements in an appropriate, horizontally oriented rail or the like; the lower end of the door element is provided with an extension 2. The extension 2 ends in an angled piece 3 that points upwardly. The angled piece 3 extends into a recess 4 of a base or bottom rail 5. The bottom rail 5 is attached to the edge 6 of the shower base 7, for example by means of an adhesive or in some other manner.

The recess 4 in the bottom rail 5 is formed, on the one hand, by a channel or groove 8, and on the other hand by a member or rod 9. When viewed in cross-section, the rod 9 is in the form of a part of a circular ring, and the shape of the inner wall of the groove 8 corresponds to the shape of the outer wall of the rod 9. In this way, both the groove 8 and the rod 9 have the same geometrical axis, so that the rod 9 can be rotated or pivoted within the groove 8 (the sides of the rod can, for example, be rotatably or pivotably guided in the non-illustrated bearings or supports that are located in the frame sections that are adjacent to the bottom rail 5). As can be readily seen from FIG. 1, if the rod 9 is rotated appropriately from the illustrated position in a counterclockwise direction into a position that differs from the illustrated position by approximately 120°, the lower end of the rod 9, indicated by the reference numeral 10, is raised to such an extent that the door element 1, along with the extension 2, can be swung out of the region of the recess 4, and away from the bottom rail 5, in the direction of the interior of the shower stall. It is then considerably easier to clean the door element, and possibly other non-illustrated door elements that can be connected to the bottom rail in the same manner via extensions having angled pieces: it is also possible to clean the bottom rail 5 itself.

Figure 2:
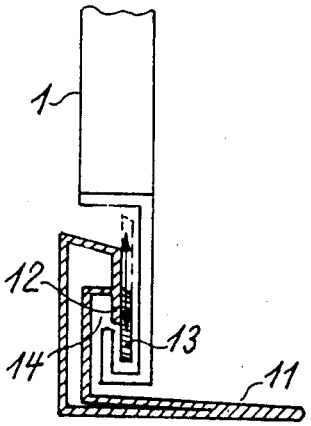

FIG. 2 shows a bottom rail 11 that is provided with an extension 12 which faces the interior of the shower stall and is also directed downwardly. Disposed approximately in the plane of the extension 12 is a strip-like element 13 which, similar to the rod 9 of the embodiment of FIG. 1, is mounted so as to be displaceable in a plane that extends parallel to the extension 12, especially in the region of those two base frame parts of the shower stall that are connected to the sides of the bottom rail 11. It should also be noted that, although not illustrated, it would also be possible to provide directly on the bottom rail 11 a bearing that permits an appropriate sliding movement, similar to the situation of the solution of FIG. 1, with the aid of suitable clamps, clips, brackets, or the like.

By sliding the strip-like element 13 upwardly, the recess 14 that is located in the bottom rail can be varied in such a way that it is possible to swing out the door element 1, as in the case of the embodiment of FIG. 1.

Figure 3:
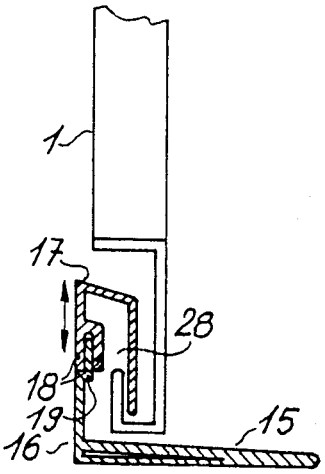

In the embodiment of FIG. 3, a removable part 17 adjoins a fixed part 15 of a bottom rail 16. On that side remote from the interior of the shower stall, the part 17 is provided with an extension 18 having an approximately U-shaped cross-sectional shape. This extension 18 extends over a corresponding extension 19 of the fixed part 15 of the bottom rail 16, with the extension 19 having an approximately I-shaped cross-sectional shape. This plug-type connection between the parts 17 and 15 of the bottom rail 16 also makes it simple top release the guidance connection between the door element 1 and the bottom rail 16.

Figure 4:
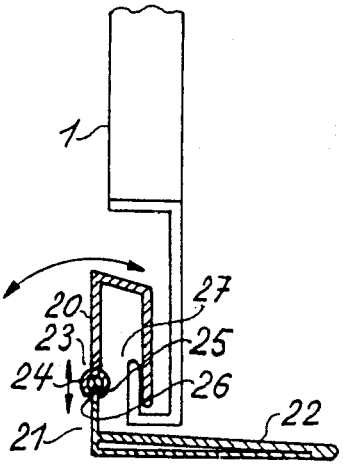

Finally, the embodiment of FIG. 4 shows a possible version in which, in addition to the possibility for complete removal, the upper part 20 of a bottom rail 21 is supported on the fixed part 22 of the bottom rail 21 in such a way as to be pivotable about an axis that extends in the longitudinal direction of the bottom rail 21. For this purpose, a connector 23 is provided and is in the form of a ball-and-socket joint comprising a channel 25 located in an extension 24, and a rod 26 that has a circular cross-sectional shape and fills the channel 25; this rod is associated with the fixed part 22 of the bottom rail 21.

The extension 24 located on the movable part 20 of the bottom rail 21 can have such an elasticity and such dimensions that the part 20 can, simply by pulling it off, be removed from the rod 26, which has a circular cross-sectional shape, or from the corresponding widened portion of the fixed part 22 of the bottom rail.

The present invention is, of course, in no way restricted to the specific disclosure of the specification and drawing, but also encompasses any modifications within the scope of the appended claims.

What I claim is:

1. In a shower stall having at least one door element, with at least one end thereof being suspended in an upper, horizontal frame portion of a fixed frame in such a way as to be movably guided on a rail via rollers or slides, while the other, lower end of each door element is provided with a first extension having an upwardly angled piece that extends into a downwardly open recess of a bottom rail that forms a further horizontal frame portion of the fixed frame, the improvement wherein: said bottom rail, to help define said recess for said angled piece, includes a wall portion that faces said door element and the interior of said shower stall, with this wall portion being supported on the remainder of said bottom rail, and being movable relative thereto, in such a way that this wall portion can be shifted from a first position, in which said wall portion overlaps said angled piece of said first extension of said door element, and prevents pivoting of said door in a direction transverse to its plane into a second position which permits a pivoting of said door element, transverse to its plane, in the direction toward the interior of said shower stall, and from said second position back into said first position.

2. A shower stall according to claim 1, in which said bottom rail further includes, to help define said recess for said angled piece, groove means that extends in the longitudinal direction of said bottom rail and is disposed on that side of the latter that faces the interior of said shower stall; said groove means has a cross-sectional shape in the form of part of a circle; and in which said wall portion of said bottom rail is in the form of a rod-like member that has a crosssectional shape in the form of part of a circular ring, and has an outer diameter that conforms to said groove means; said rod-like member is guided in said groove means in such a way as to be rotatable about a geometric axis that is common to both said rod-like member and said recess for said angled piece.

3. A shower stall according to claim 1, in which said bottom rail, on that side of the latter that faces the interior of said shower stall, to help define said recess for said angled piece, further includes groove means that extends in the longitudinal direction of said bottom rail; and in which said wall portion of said bottom rail is associated with said groove means and is in the form of a strip-like element that is disposed in such a way on that side of said bottom rail that faces the interior of said shower stall that said strip-like element can be shifted in an approximately vertical plane.

4. A shower stall according to claim 1, in which that portion of said bottom rail that forms said recess for said angled piece is connected to the remainder of said bottom rail in such a way that it is rotatable about a horizontal axis that is remote from the interior of said shower stall.

5. A shower stall according to claim 4, in which said rotatable connection between said recess portion of said bottom rail and the remainder of the latter is a detachable connection.

6. A shower stall according to claim 1, in which that portion of said bottom rail that forms said recess for said angled piece is detachably connected to the remainder of said bottom rail.

7. A shower stall according to claim 6, in which said remainder of said bottom rail is provided with an approximately I-shaped extension, and in which that portion of said bottom rail that forms said recess is provided with an approximately U-shaped extension that can be placed over said I-shaped extension.

* * * * *